US006511067B1

(12) United States Patent
Butler et al.

(10) Patent No.: US 6,511,067 B1
(45) Date of Patent: Jan. 28, 2003

(54) ROW-FORMING MARBLE BOARD GAME

(76) Inventors: Robert W. Butler, 5410 NE. 48TH St., Kansas City, MO (US) 64119; Lisa G. Butler, 5410 NE. 48TH St., Kansas City, MO (US) 64119

( * ) Notice: Subject to any disclaimer, the term of this patent is extended or adjusted under 35 U.S.C. 154(b) by 0 days.

(21) Appl. No.: 09/849,413

(22) Filed: May 4, 2001

(51) Int. Cl.[7] ..... A63F 3/00
(52) U.S. Cl. ..... 273/153 J; 273/242; 273/266
(58) Field of Search ..... 273/267, 269, 273/271, 275, 153 J, 248, 236, 242, 260, 261, 264, 266

(56) References Cited

U.S. PATENT DOCUMENTS

| | | | | | |
|---|---|---|---|---|---|
| 1,558,690 | A | | 10/1925 | Mccollom | |
| 1,564,746 | A | | 12/1925 | Barnard | |
| D116,559 | S | | 9/1939 | Fisher | |
| 3,464,124 | A | * | 9/1969 | Lynd | 273/269 |
| 3,549,150 | A | * | 12/1970 | Weeks | 273/269 |
| 3,563,551 | A | * | 2/1971 | Weisbecker | 273/271 |
| 3,877,699 | A | * | 4/1975 | Reiner | 273/119 R |
| 4,015,850 | A | * | 4/1977 | Russell | |
| 4,213,616 | A | * | 7/1980 | Dickey | 273/271 |
| 4,795,160 | A | * | 1/1989 | Sterling | 273/269 |
| 4,953,869 | A | * | 9/1990 | Muhammad | 273/141 R |
| 5,139,270 | A | * | 8/1992 | Gernhofer | 273/269 |
| 5,386,994 | A | | 2/1995 | Baranowski | |
| 5,458,338 | A | * | 10/1995 | Beardsley | 273/269 |
| 5,692,753 | A | | 12/1997 | Falk | |
| 5,758,876 | A | | 6/1998 | Frick et al. | |

* cited by examiner

*Primary Examiner*—Benjamin H. Layno
*Assistant Examiner*—Vishu K Mendiratta

(57) ABSTRACT

A row-forming marble board game for entertainment and for being the first player to line up one's marbles in a particular row. The row-forming marble board game includes a board member having a top side and a grid being disposed upon the top side and dividing the top side into a plurality of distinct marble placement sections with each of the marble placement sections being uniquely numbered; and also includes sets of marbles for placement upon the marble placement sections; and further includes a deck of playing cards with each playing card having a number corresponding to a particular marble placement section being displayed upon a side thereof.

1 Claim, 2 Drawing Sheets

ROW-FORMING MARBLE BOARD GAME

BACKGROUND OF THE INVENTION

1. Field of the Invention

The present invention relates to marble-playing board games and more particularly pertains to a new row-forming marble board game for entertainment and for being the first player to line up one's marbles in a particular row.

2. Description of the Prior Art

The use of marble-playing board games is known in the prior art. More specifically, marble-playing board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,558,690; 5,386,994; U.S. Pat. No. Des. 116,559; U.S. Pat. Nos. 5,692,753; 5,758,876; and 1,564,746.

While these devices fulfill their respective, particular objectives and requirements, the aforementioned patents do not disclose a new row-forming marble board game. The inventive device includes a board member having a top side and a grid being disposed upon the top side and dividing the top side into a plurality of distinct marble placement sections with each of the marble placement sections being uniquely numbered; and also includes sets of marbles for placement upon the marble placement sections; and further includes a deck of playing cards with each playing card having a number corresponding to a particular marble placement section being displayed upon a side thereof.

In these respects, the row-forming marble board game according to the present invention substantially departs from the conventional concepts and designs of the prior art, and in so doing provides an apparatus primarily developed for the purpose of entertainment and for being the first player to line up one's marbles in a particular row.

SUMMARY OF THE INVENTION

In view of the foregoing disadvantages inherent in the known types of marble-playing board games now present in the prior art, the present invention provides a new row-forming marble board game construction wherein the same can be utilized for entertainment and for being the first player to line up one's marbles in a particular row.

The general purpose of the present invention, which will be described subsequently in greater detail, is to provide a new row-forming marble board game which has many of the advantages of the marble-playing board games mentioned heretofore and many novel features that result in a new row-forming marble board game which is not anticipated, rendered obvious, suggested, or even implied by any of the prior art marble-playing board games, either alone or in any combination thereof.

To attain this, the present invention generally comprises a board member having a top side and a grid being disposed upon the top side and dividing the top side into a plurality of distinct marble placement sections with each of the marble placement sections being uniquely numbered; and also includes sets of marbles for placement upon the marble placement sections; and further includes a deck of playing cards with each playing card having a number corresponding to a particular marble placement section being displayed upon a side thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new row-forming marble board game which has many of the advantages of the marble-playing board games mentioned heretofore and many novel features that result in a new row-forming marble board game which is not anticipated, rendered obvious, suggested, or even implied by any of the prior art marble-playing board games, either alone or in any combination thereof.

It is another object of the present invention to provide a new row-forming marble board game which may be easily and efficiently manufactured and marketed.

It is a further object of the present invention to provide a new row-forming marble board game which is of a durable and reliable construction.

An even further object of the present invention is to provide a new row-forming marble board game which is susceptible of a low cost of manufacture with regard to both materials and labor, and which accordingly is then susceptible of low prices of sale to the consuming public, thereby making such row-forming marble board game economically available to the buying public.

Still yet another object of the present invention is to provide a new row-forming marble board game which provides in the apparatuses and methods of the prior art some of the advantages thereof, while simultaneously overcoming some of the disadvantages normally associated therewith.

Still another object of the present invention is to provide a new row-forming marble board game for entertainment and for being the first player to line up one's marbles in a particular row.

Yet another object of the present invention is to provide a new row-forming marble board game which includes a board member having a top side and a grid being disposed upon the top side and dividing the top side into a plurality of distinct marble placement sections with each of the marble placement sections being uniquely numbered; and also includes sets of marbles for placement upon the marble placement sections; and further includes a deck of playing cards with each playing card having a number corresponding to a particular marble placement section being displayed upon a side thereof.

Still yet another object of the present invention is to provide a new row-forming marble board game that is easy to learn by all ages.

Even still another object of the present invention is to provide a new row-forming marble board game that is an ideal and challenging game to be played while traveling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
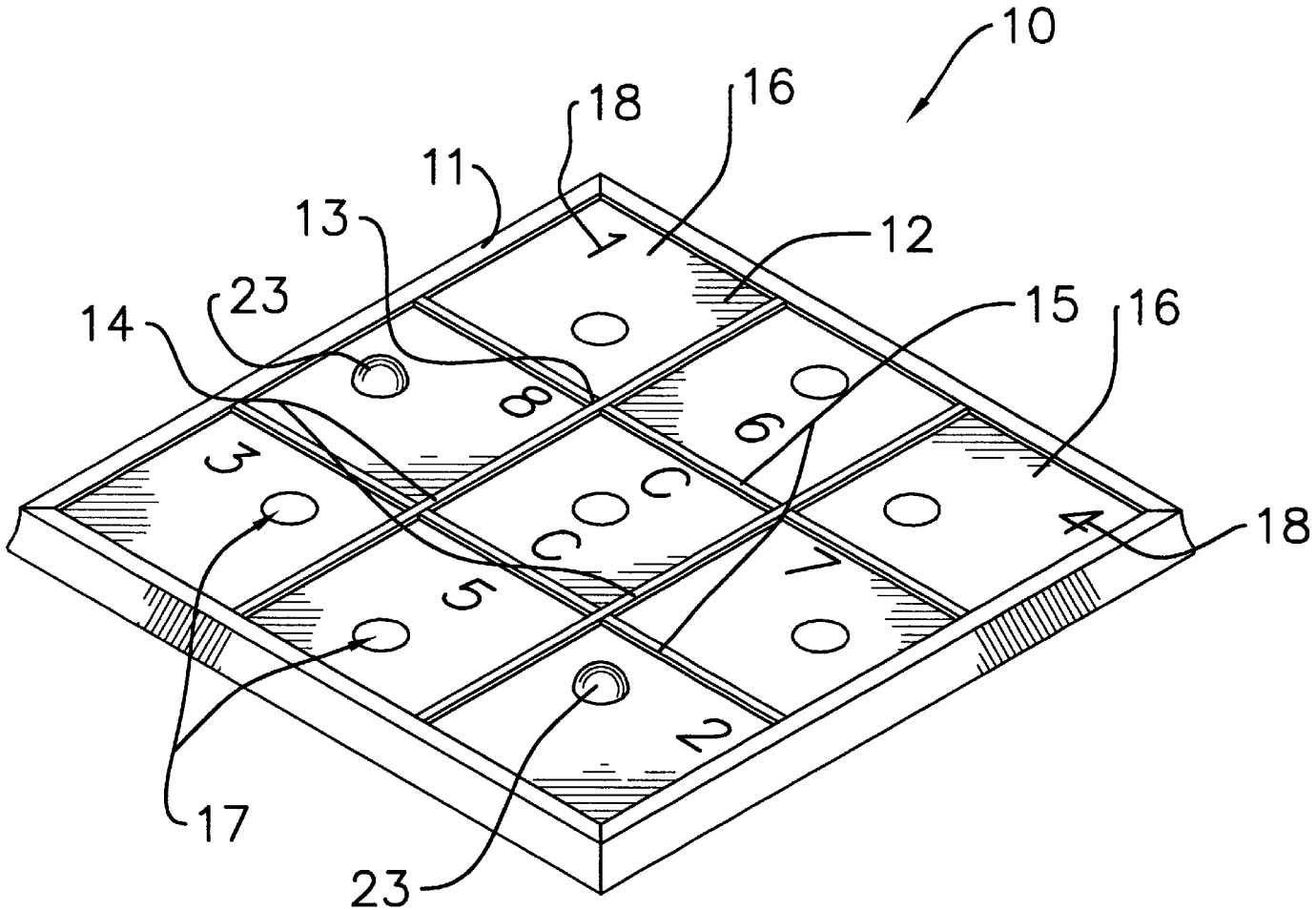
FIG. 1 is a perspective view of a game board of a new row-forming marble board game according to the present invention.
Figure 2:
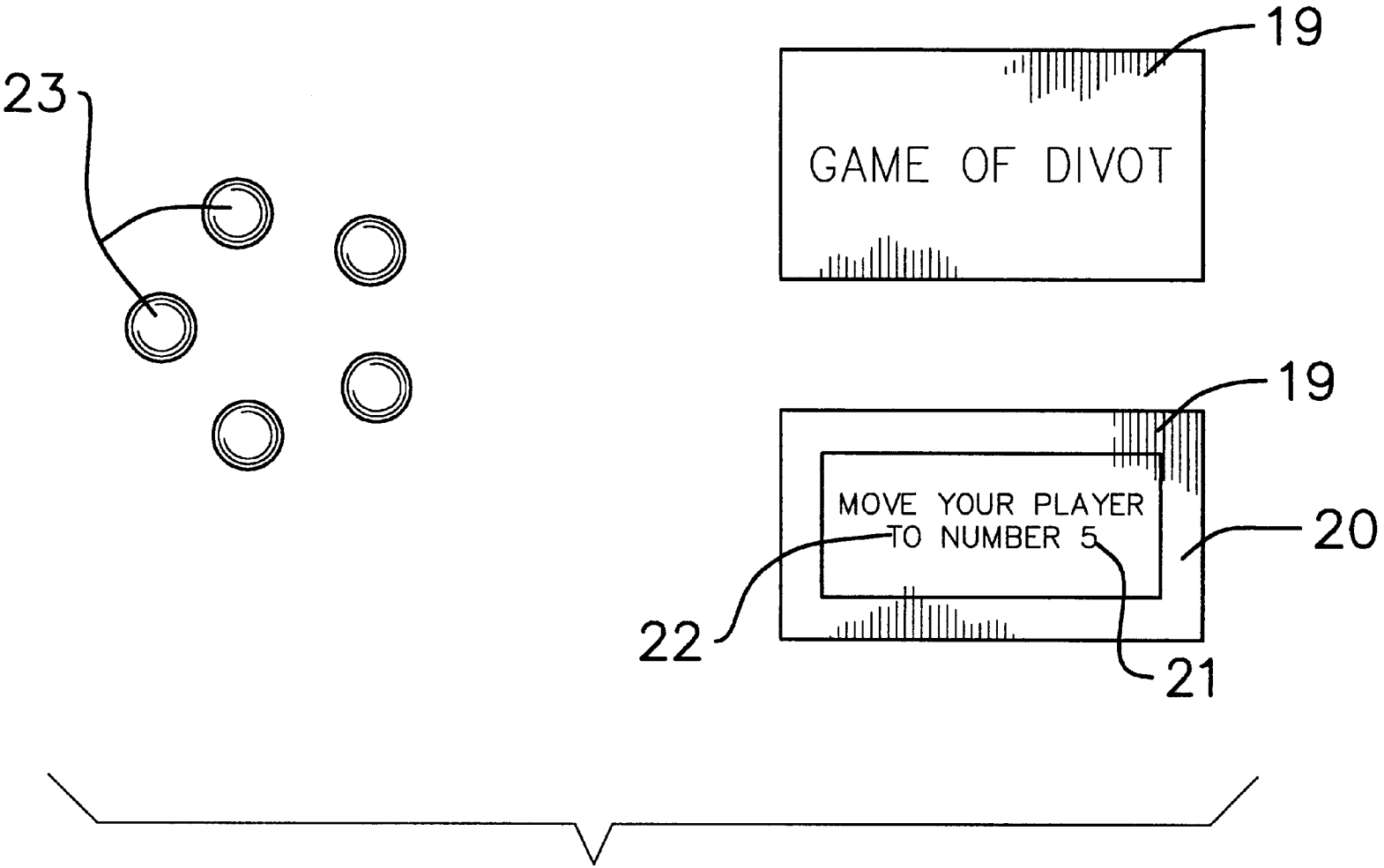
FIG. 2 is a front and back views of a playing card and marbles of the present invention.

With reference now to the drawings, and in particular to FIGS. 1 through 2 thereof, a new row-forming marble board game embodying the principles and concepts of the present invention and generally designated by the reference numeral 10 will be described.

As best illustrated in FIGS. 1 through 2, the row-forming marble board game 10 generally comprises a board member 11 having a top side 12 and a grid 13 being conventionally disposed upon the top side 12 and dividing the top side 12 into a plurality of distinct marble placement sections 16 with each of the marble placement sections 16 being uniquely numbered. The grid 13 includes first and second pairs of elongate cross members 14,15 being disposed upon the top side 12 of the board member 11 with the first pair of elongate cross members 14 intersecting the second pair of elongate cross members 15 to form the marble placement sections 16. The board member 11 also includes a plurality of marble-holding slots 17 being disposed in the top side 12 thereof with each of the marble-holding slots 17 being disposed in a respective marble placement section 16. The board member 11 further includes numbers 18 being conventionally displayed upon the top side 12 thereof with each of the numbers 18 being disposed upon a respective marble placement section 16. The marble placement sections 16 are arranged in a 3 by 3 format.

Sets of marbles 23 for placement upon the marble placement sections 16 include 8 marbles per set. A deck of playing cards with each playing card 19 having a number 21 corresponding to a particular the marble placement section 16 being conventionally displayed upon a side 20 thereof with each of the playing cards 19 including words "MOVE YOUR PLAYER TO NUMBER" 22 being conventionally displayed upon the side 20 thereof.

In use, each player draws one of the playing cards 19 from the deck of playing cards and the player having drawn the highest number shown the drawn playing card 19 begins play. Each player then alternatively selects a playing card 19 from the deck, and places one's marble 23 upon the marble-holding slot 17 of the marble placement section 16 corresponding to the number 21 displayed on the selected playing card 19 if the marble placement section 16 is not already occupied with another marble 23. Each player takes turns drawing a playing card 19 from the deck until one of the players forms a row of one's marbles 23 to win the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A row-forming marble board game comprising:

a board member having a top side and a grid being disposed upon said top side and dividing said top side into a plurality of distinct marble placement sections, said grid including first and second pairs of elongate cross members being disposed upon said top side of said board member with said first pair of elongate cross members intersecting said second pair of elongate cross members to form said marble placement sections, said board member also including a plurality of marble-holding slots being disposed in said top side thereof with each of said marble-holding slots being disposed in a respective said marble placement section, said board member further including numbers being displayed upon said top side thereof with each of said numbers being disposed upon a respective said marble placement section, said marble placement sections being arranged in a 3 by 3 format;

sets of marbles for placement upon said marble placement sections with each said set of marbles including 8 marbles; and a deck of playing cards with each playing card having a number corresponding to a particular said marble placement section being displayed upon a side thereof, each of said playing cards including words "MOVE YOUR PLAYER TO NUMBER" being displayed upon said side thereof;

wherein each of said discrete marble placement sections has a unique number marked thereon;

wherein each unique number is drawn from a series of integer numbers beginning at the number one and ascending in sequential order without skipping an integer number;

wherein one of said marble placement sections comprises a central marble placement section located at a center of said board member, said central marble placement section having a "C" marked thereon and not having any number marked thereon;

wherein said board member has four corner marble placement sections, each pair of said corner marble placement sections located at opposite corners of said board member having sequentially adjacent integer numbers selected from said series of integer numbers;

wherein said marble holding slots are arranged in a circular pattern and the marble-holding slot of a central said marble placement section is located at a center of said circular pattern.

* * * * *